United States Patent [19]

Berruti

[11] Patent Number: 4,856,922

[45] Date of Patent: Aug. 15, 1989

[54] TWO-COLOR PRINTER

[75] Inventor: Pierangelo Berruti, Chivasso, Italy

[73] Assignee: Ing. C. Olivetti & C., S.p.A., Ivrea, Italy

[21] Appl. No.: 141,976

[22] Filed: Jan. 11, 1988

[30] Foreign Application Priority Data

Jan. 30, 1987 [IT] Italy ..... 67058 A/87

[51] Int. Cl.[4] ..... B41J 1/22; B41J 27/02

[52] U.S. Cl. ..... 400/145.2; 400/152; 400/157.2; 400/216.1; 400/470; 178/35

[58] Field of Search ..... 400/145.2, 146, 257, 400/145, 145.1, 147, 148, 154.1, 154.4, 154.5, 155.1, 185, 186, 187, 470, 152, 157.2, 216.1; 178/34, 35, 40

[56] References Cited

U.S. PATENT DOCUMENTS

| | | | |
|---|---|---|---|
| 4,386,861 | 6/1983 | Kurihara et al. | 400/470 X |
| 4,430,935 | 2/1984 | Fushimoto | 400/154.2 |
| 4,458,589 | 7/1984 | Watanabe et al. | 400/157.2 X |
| 4,494,885 | 1/1985 | Watanabe et al. | 400/470 X |
| 4,534,665 | 8/1985 | Mori et al. | 400/145.2 |
| 4,611,938 | 9/1986 | Rettke et al. | 400/216 X |
| 4,632,581 | 12/1986 | Ito et al. | 400/145.2 X |
| 4,655,130 | 4/1987 | Kyogoku et al. | 400/145.2 X |
| 4,697,942 | 10/1987 | Yagi et al. | 400/216.1 X |

FOREIGN PATENT DOCUMENTS

| | | | |
|---|---|---|---|
| 2068 | 1/1980 | Japan | 400/152 |
| 100089 | 6/1982 | Japan | 400/145.2 |
| 160679 | 10/1982 | Japan | 400/470 |
| 194579 | 11/1983 | Japan | 400/470 |

*Primary Examiner*—Edgar S. Burr
*Assistant Examiner*—James R. McDaniel
*Attorney, Agent, or Firm*—Banner, Birch, McKie & Beckett

[57] ABSTRACT

The printer is mounted on a desk-top computer and can print both numeric characters and graphic and calculation symbols in two different colors. The characters and the symbols are provided in a relief configuration in accordance with a matrix of rows and columns on a rubber sheet wrapped around a rotatable drum. The characters in adjacent columns are inked by an inking roller formed by adjacent porous discs which are alternately impregnated with red and black ink. The drum can perform a translatory movement in the axial direction selectively to present to the printing hammers the columns of characters which are linked with black and the columns of characters which are linked with red. The drum is translated fixedly with respect to the inking roller by means of a cam which rotates at a speed half the speed of the drum and engaged with one or other of two cam follower pins which can be selected by means of a solenoid.

8 Claims, 3 Drawing Sheets

10
11
12
14
15
16
18
19
20
21
21a
21b
22
24
25
26
27
30
31
32
33
34
35
37
38
38a
38b
40
42
44
46
48
49
50
51
55
56
57
58
59
60
62
64
67
68
69
70
72
74
76
80
82
84
86
87
93
94
95
96
97
97'
97"
98
99
100
101
102
180°
180°
E
P
M1
M2
M11
C1
C3
I
II
III
IV

TWO-COLOR PRINTER

BACKGROUND OF THE INVENTION

A two-color serial printer is known, from U.S. Pat. No. 4,430,935, comprising two character wheels, two inking rollers of different colors and two hammers for printing the characters on each of the two wheels on a strip of paper interposed between the hammers and the character wheels. The character wheels, the rollers and the hammers can move synchronously to print one character at a time along a line of printing over the entire width of the paper. By selectively activating one or the other of the hammers, it is possible to print with one or other of two different colors. That printer is very slow since the selected character wheel has to pass successively through all the printing positions in order to print a complete row of characters.

Another printer is also known from the U.S. Pat. No. 4,458,589 in which the characters are disposed in a relief configuration on a rubber mat or sheet which is wrapped around a rotatable drum. A single inking roller rolls against the drum to ink in a single color all the characters which are printed in a serial mode by a line of hammers disposed within the drum the inking roller cannot be easily replaced by a roller of another color, so that the printer cannot print in two colors.

SUMMARY OF THE INVENTION

The technical problem of the present invention is to provide a fast, compact two-color printer which is of a simple construction and which is of limited cost.

The above-indicated technical problem is solved by the two-color printer according to the invention wherein the inking roller comprises a plurality of juxtaposed inking discs which are alternately impregnated with ink of different colors for inking the characters of a first circumference of said pair with a first color and the characters of a second circumference of said pair with a second color, the character drum being selectively displaceable axially by one pitch step in a first direction and by one pitch step in an opposite direction with respect to a central position for printing said symbols in said printing positions with one of the other of said colors respectively.

These and other features will be more clearly apparent from the following description of the preferred embodiment which is given by way of non-limiting example with reference to the accompanying drawings.

DESCRIPTION OF THE PREFERRED EMBODIMENT

Figures 1, 7:
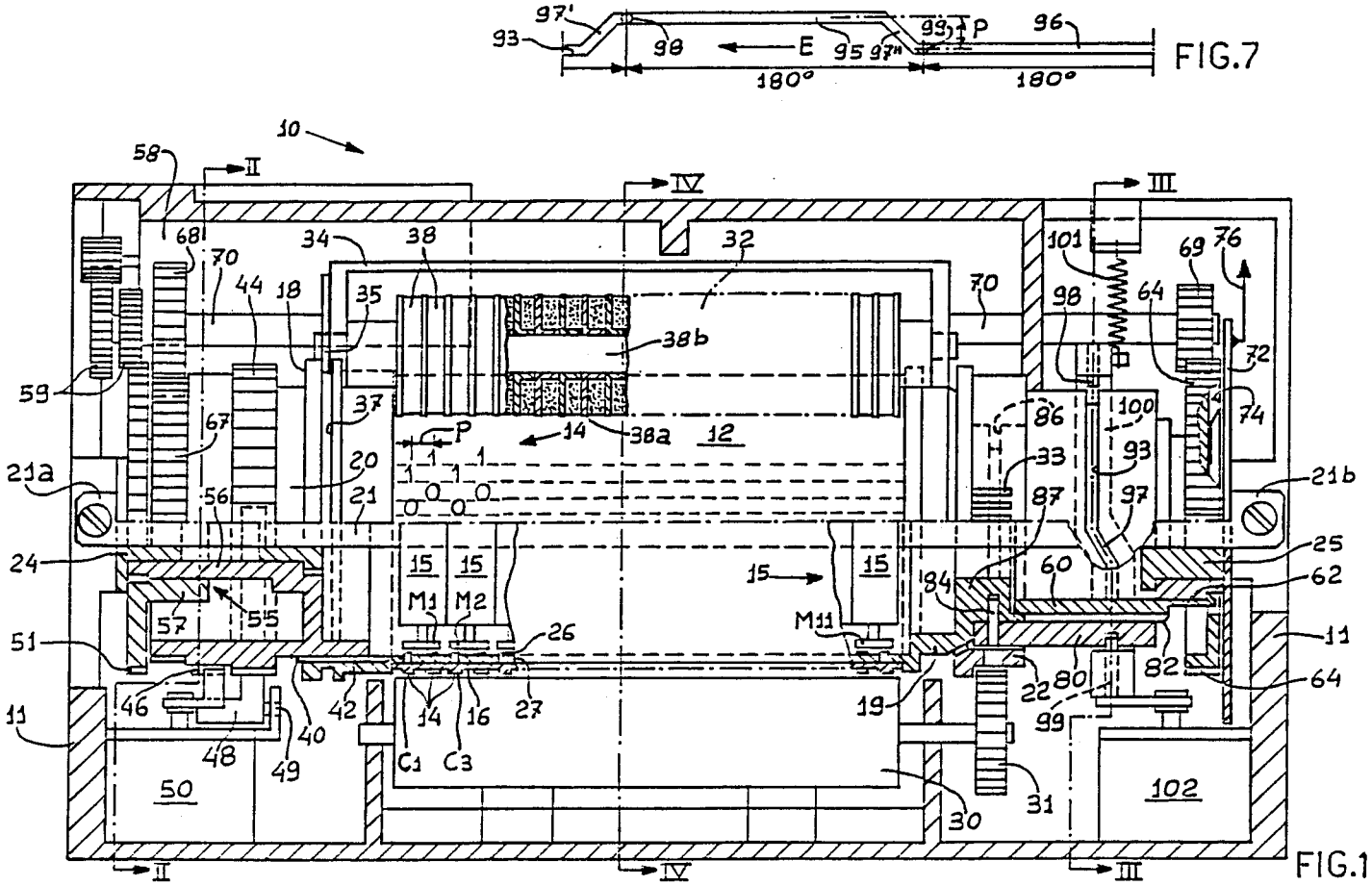
FIG. 1 is a plan view of the printer according to the invention.
FIG. 7 is a flat development of a cam.

Referring to FIG. 1, the printer 10 comprises a hollow cylindrical drum 12 which on its outside surface carries characters 14 to be printed, which comprise a series of digits 0 to 9 and a group of graphic signs which are normally used in numerical calculation operations.

The characters 14 are provided in a relief configuration on a rubber mat or sheet 16 which is wrapped around the outside surface of the drum 12. The characters 14 are arranged on the sheet 16 along for example 22 juxtaposed character circumferences.

Figure 5:
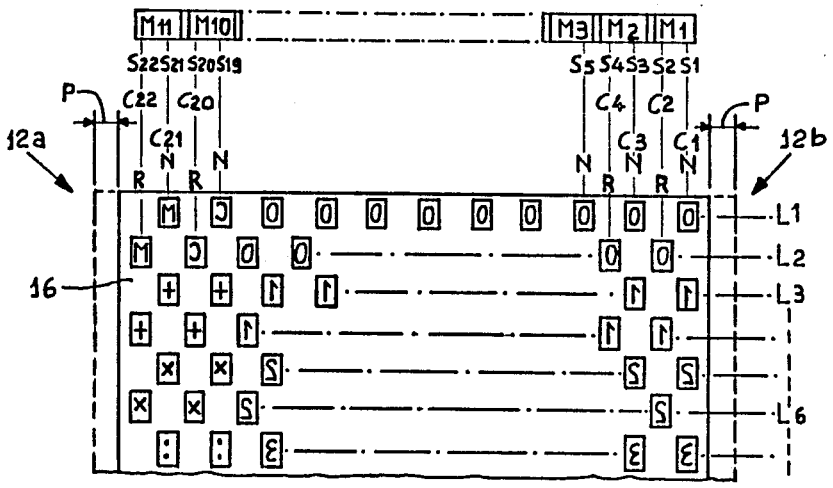
FIG. 5 is a diagrammatic representation of the characters with respect to the print positions.

Each circumference $C_1$–$C_{22}$ (FIG. 5) includes ten characters, each one occupies on its own circumference angular positions which are angularly-shifted through a constant angle '$2\alpha$'; the adjacent character circumferences are spaced from each other by a printing pitch 'p' and are angularly displaced relative to each other by half an angular position, that is to said '$\alpha$' (see FIG. 2) so that the characters occur successively in alternate positions along a printing row.

The drum 12 is rotatable about its own axis and is supported at its ends 18 and 19 respectively by two cylindrical coaxial elements 20 and 22 which are rotatable on corresponding support bushes 24 and 25 which are fixed with respect to the base portion 11.

Figure 4:
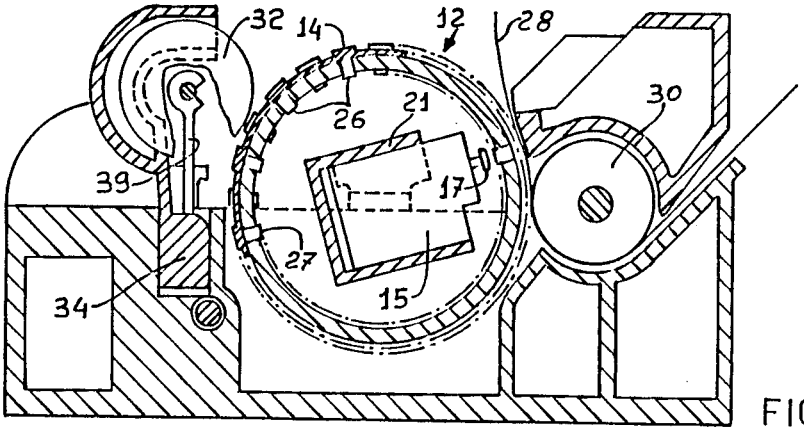
FIG. 4 is a view in section taken along line IV—IV in FIG. 1.

Disposed within the drum 12 are printing solenoids 15, each provided with a hammer M which are shaped in such a way as to cover two contiguous printing steps 'p'. The solenoids 15 are fixed on a frame 21 which extends within the drum 12 parallel to the axis thereof and which is fixed at its ends **21*a* and 21*b* to the base portion 11. Each hammer hits a striker pin 26 (see FIG. 4) which is fixed at the rear to each character and which passes through openings 27 provided in the drum 12. In that way the characters 14 are pressed against a strip of paper 28 which passes on the outside of the drum 12 and which is advanced by means of a roller 30**, as will be described hereinafter.

Since, as already indicated hereinbefore, the characters on the drum 12 appear in alternate printing positions, both on each row of characters and along each character circumference, to be able to print the characters 14 on the strip of paper 28 in all the printing positions of a row, it is necessary in each printing cycle axially to move the drum by a step 'p' so that each hammer M prints in the first printing position S1 (FIG. 5) a character of a first circumference C1 and in a second adjacent printing position another character on an adjacent third circumference C3, as will be described in detail hereinafter.

The characters 14 are inked by an inking roller 32 (FIG. 1) which is parallel to the axis of the drum 12 and which is rotatable on a support 34 slidable parallel to the axis of the drum 12 and moved axially by the drum itself by means of a tooth 35 (FIG. 1) engaged with a groove 37 in the drum 12. The roller 32 is formed by a number of inked rings 38 (FIG. 1), equal to the number of character circumferences 14. The rings 38 of absorbent material are saturated alternately with ink of different colors, for example black and red, whereby the characters 14 of adjacent circumferences C1, C2, C3 (see FIG. 5) are inked in different colors. The rings 38 are separated by impermeable circular walls **38*a* mounted on a shaft 38*b* which is rotatable on the support 34. The roller 32 is supported by elastic arms 39 (see FIG. 4**)

connected to the support 34 in such a way as suitably to press the roller 32 against the drum 12.

The drum 12 is rotated by means of a tooth 40 (see FIG. 1) which project radially from the cylindrical element 20 and which is received in a recess 42 in the drum 12 in such a way as to permit the axial sliding movement of the drum 12 with respect to the element 20. On its outside the cylindrical element 20 carries a ring of teeth 44 and a single tooth 46 which is disposed adjacent to the ring of teeth 44. The teeth 44 are angularly offset therebetween by the angle "$\alpha$", so that each tooth 44 corresponds to each one of the rows $L_1$–$L_{20}$ (FIG. 5) of characters on the drum 12. The teeth 44 and the single tooth 46 alternately engage with a ratchet assembly 48 (see FIG. 2) which is pivoted at 49 on the base portion 11 and controlled by a solenoid 50. The ratchet mechanism 48 comprises two latch portions 52 and 53 capable of respectively engaged the teeth 44 and the single tooth 46. Normally the ratchet mechanism 48 is rotated in an anti-clockwise direction by a spring 54 to hold the latch portion 53 in engagement with the single tooth 46.

The cylindrical element 20 is rotated by a gear 51 by way of a friction clutch 55 provided between a projection 56 on the element 20 and a hub 57 on the gear 51. The gear 51 is in turn driven by a DC motor 58 by way of two reducing gears 59. Therefore when one or other of the latch portions 52 and 53 holds the cylindrical element 20 stationary, the motor can continue to rotate by virtue of the friction clutch 55. The cylindrical element 22 which supports the end 19 of the drum 12 (at the right in FIG. 1) is fixed with respect to a ring 60 which is concentric with the axis of the drum 12. The ring 60 is connected by means of resilient latch portions 62 to a toothed wheel 64 which is coaxial with the ring 60 and which is rotatable on the support bush 25 fixed to the base portion 11.

The toothed wheel 64 is rotated by the cylindrical element 20 by way of the gears 67, 68 and 69 of which the gear 67 is fixed with respect to the cylindrical element 20 while the gears 68 and 69 are mounted on a shaft 70 parallel to the axis of the drum 12 and respectively engage with the gear 67 and the wheel 64. The transmission ratio between the element 22 and the wheel 64 is 2:1 whereby, while the drum 12 rotates through one revolution, the toothed wheel 64 rotates through 180°.

Fixed to the base portion 11 in front of the toothed wheel 64 is a printed circuit board 72 carrying a plurality of electrical contacts (not shown in the drawings) which are angularly spaced by the half the angle "$\alpha$" and against which rubs a resilient conducting tongue 74 mounted on the wheel 64 to generate on a line 76 strobe signals corresponding to the angular positions of the characters on the drum 12. Mounted over the ring 60 is a cylindrical barrel portion 80 which is entrained in rotation by the ring 60 by means of an axial key 82. The barrel portion 80 is also connected to the drum 12 by means of a radial pin 84, engaging with a circular groove 86 in the drum 12.

Provided on the outside surface of the barrel portion 80 is a channel 93 comprising two portions 95 and 96 which are connected by inclined portions 97' and 97'' (see FIG. 7). The two portions 95 and 96 are straight and parallel and are displaced relative to each other by the pitch '2'. One or other of two cam follower pins 98 and 99 which are mounted at 180° from each other on an arcuate support 100 can engage selectively into the channel 93 (see FIG. 3). The support 100 is fixed in the axial direction and is moved radially by a solenoid 102 from a first position in which it is held by a spring 101 and in which the pin 98 is in engagement with the portion 95 of the channel 93, to a second position in which the pin 99 is engaged with the portion 96 of the channel 93. The drum 12 is held in an angular rest position by the latch portion 53 (see FIG. 2) engaged with the single tooth 46. In that position the barrel portion 80 is oriented in such a way that the pins 98 and 99 (see FIG. 7) are in positions corresponding to the beginnings of the respective portions 95 and 96 with respect to the direction of movement E. By leaving for example the pin 99 engaged (see FIG. 1), at the end of each revolution of the drum 12, the cam 93 displaces the drum 12 axially by a step 'p', first toward the right and then in the opposite direction. On the other hand, by leaving the pin 98 engaged, the drum is moved axially first towards the left and at the end of the second revolution towards the right.

Figure 6:
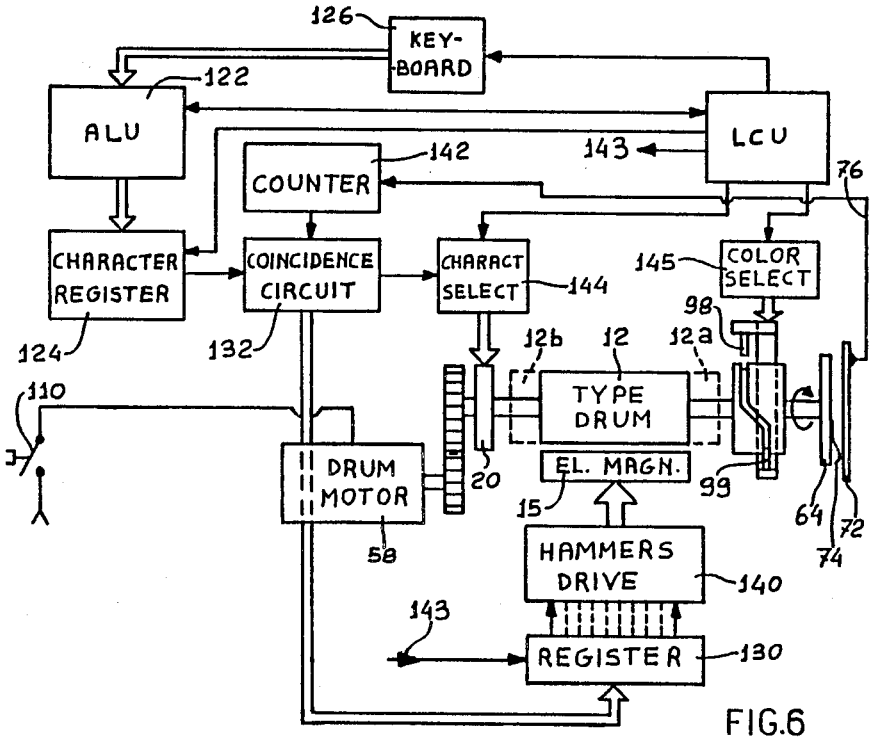
FIG. 6 is a block circuit diagram of a control circuit of the printer of FIG. 1.

The rotary movement of the drum 12 and selection of the characters to be printed is produced under the control of a circuit (see FIG. 6) in response to the strobe signals produced on the line 76 by the rubbing contact 74. When the machine is started up by means of the switch 110, the motor 58 is set in continuous rotation but, by virtue of the friction clutch 55 (see FIG. 1) the drum 12 remains stationary since the latch portion 53 holds the tooth 46 (see FIG. 2).

The printing operations take place during two complete revolutions of the drum 12. When a color, for example black, is selected, in the first revolution characters are printed in the odd-numbered printing positions while in the second revolution, characters are printed in the even-numbered positions of the same printing row. When the other color, red, is selected, in the first revolution characters are printed in the even-numbered printing positions while in the second revolution of the drum characters are printed in the odd-numbered printing positions.

The control circuit (FIG. 6) comprises a logic control unit LCU adapted to control an arithmetic logic unit (ALU) 122 and a keyboard unit 126, which includes the conventional keyboard encoder and control circuitry. The control unit LCU under the control of a permanently stored program causes the keyboard 126 to transfer to the arithmetic unit 122 the binary informations corresponding to each one of the keys of the keyboard 126.

The arithmetic unit 122 under the control of the unit LCU performs the arithmetical operations to give the numerical results of calculations and the positive or negative sign of the results. The control unit LCU is also controlled by the arithmetic unit 122 to select the printing color of characters to be printed. For example the positive numbers and the mathematical symbols, except the minus sign (−), are to be printed in black, while the negative numbers preceded by the (−) sign are to be printed in red.

The ALU 122 includes a transcoder which is adapted to transcode the code of each character to a code formed by four bits and representative of the angular position of the character on the drum 12. The ALU 122 under the control of the unit LCU transfers the characters so translated to a character register 124 including 11 locations, each one associated with a corresponding printing position, whereby in each printing cycle each location of the register 124 stores the angular position of the character to be printed.

Since the entire line of characters to be printed are printed in two subsequent printing cycles, the LCU during a first rotation of the drum 12, causes the arithmetic unit 122 to transfer to the register 124 the transcoded characters to be printed in the odd printing positions and during a second revolution of the drum 12, to transfer to the register 124 the transcoded characters to be printed in the even printing positions, as it will be explained hereinbelow.

The angular positions of the drum 12 are detected by a counter 142, by counting the pulses generated by the sliding contact 74.

A coincidence circuit 132, formed of 11 sections associated to the locations of the register 124, compares each time the contents of the counter 142 with the transcoded characters to be printed, stored in the register 124.

Whenever the angular position of the drum 124 equals the character code, the corresponding section of the circuit 132 generates a character selection signal which is transferred to a buffer 130.

The buffer 130 is a latching register of capacity of 11 bits for storing the character selection signals of the 11 characters to be printed.

A drive circuit 140 is activated by the register 130 under the control of a strobe supplied by LCU on the connection 143 to cause the hammers 15 to print the selected characters.

The printing color may be manually selected by means of a key, not shown, of the keyboard 126, or, as previously described, the color selection may be performed through the control unit LCU according to the calculation results of the arithmetic unit 122.

In greater detail, the printing operations take place in the following manner.

PRINTING IN BLACK

Under the control of an operator key (not shown) of the keyboard 126, the LCU activates a character selection circuit 144 which, with a 10 msec pulse energises the solenoid 50 (FIG. 2) to free the single tooth 46 from the latch portion 53. The drum 12 begins to rotate in the anti-clockwise direction, entrained by the friction clutch 55 (see FIG. 1), while the pin 99 engages into the portion 96 (see FIG. 7) of the cam 94.

During the first revolution of the drum 12 it is possible to print in black, as already stated hereinbefore, the characters on the odd-numbered circumference C1, . . . C21 (see FIG. 5) in the odd-numbered printing positions S1 . . . S21. Therefore, the coincidence circuit 132 (see FIG. 6) activates the solenoid 50 at successive intervals by way of the circuit 144 to lock the drum 12 by means of the latch portion 52 (see FIG. 2) in the angular positions corresponding to the odd-numbered lines of characters L1, L3, L5, . . . (see FIG. 5).

At the same time the buffer 130 is enabled to activate, each time that the drum stops, the circuit 140 for actuation of the hammers M for printing the selected characters. Before being stopped at the end of the first revolution, the drum 12 is axially translated by a step 'p' towards the right in FIG. 6 into the position 12*a* (at the left in FIG. 5) by the inclined portion 97' of the cam 93 (FIG. 7), since the latter has only performed half a revolution. Therefore the circumferences C3, . . . C21 (see FIG. 5) of the characters which are inked black are moved into positions corresponding to the printing positions S2, . . . S20 in which the remaining black characters are printed during the second revolution of the drum 12, in the manner already referred to above. At the end of the second revolution, the drum is returned by the portion 97" of the cam 93 (FIG. 7) into the initial axial position and is stopped by the latch portion 53 bearing against the single tooth 46 (see FIG. 2).

Shortly before the drum 12 stops, after two revolutions equivalent to a revolution of the cam 93 and the cylindrical element 22 (see FIG. 1), the roller 30 for feeding the paper 28 (FIG. 4) is rotated by a line spacing by means of a gear 31 (FIG. 1) which engages with three teeth 33 carried by the cylindrical element 22.

PRINTING IN RED

The LCU enables a color selection circuit 145 (see FIG. 6) to energise the solenoid 102 (see FIG. 3) in such a way as to engage the pin 98 into the portion 95 (see FIG. 7) of the cam 93. During the first revolution of the drum 12, the characters in red of the even-numbered circumferences C2,. . . C22 are printed in the above-described manner, at the corresponding even printing positions S2, S4 . . . etc. The coincidence circuit 132 now stops the drum 12 at a position corresponding to the even-numbered lines L2, L4 . . . etc (see FIG. 5) which contain the red-inked characters.

At the end of the first revolution of the drum 12, the pin 98 engages into the portion 97" of the cam 94 (see FIG. 7) which has rotated through 180°, and moves the drum towards the left (see FIG. 6) into the position 12*b* (at the right in FIG. 5) whereby the characters on the even circumferences C2, C4 . . . C22 are in positions corresponding to the odd-numbered printing positions S1, S3, . . . S21 (see FIG. 5). Thus during the second revolution of the drum 12, the red-colored characters can be printed, in the odd-numbered printing positions S1, . . . S21, completing a row of printing in red.

Figure 2:
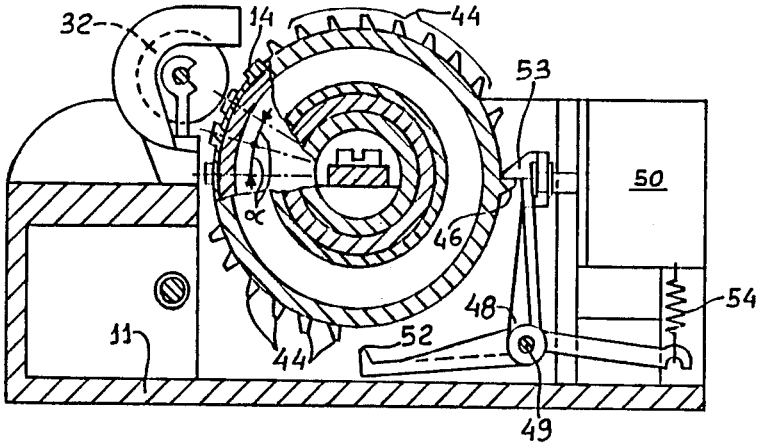
FIG. 2 is a view in cross-section taken along line II—II in FIG. 1.
Figure 3:
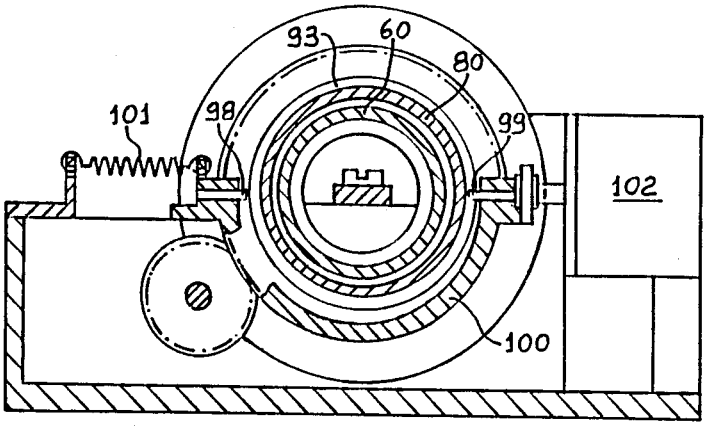
FIG. 3 is a view in cross-section taken along line III—III in FIG. 1.

At the end of the second revolution, the paper 28 is advanced by a line spacing while the drum 12 is returned by a step 'p' to the right (see FIG. 6) and thus locked by the tooth 46 and the latch portion 53 (see FIG. 2).

It will be appreciated that modifications, additions and substitution of parts may be made in the above-described two-color serial printer without thereby departing from the scope of the present invention.

I claim:

1. A two color parallel printer for impact printing alfa-numeric symbols on a printing line, comprising a frame, a hollow character drum rotatable on said frame and extending through the entire length of said line, said drum carrying a plurality of characters disposed on the outside surface of the drum at a constant angular spacing on a plurality of pairs of adjacent circumferences axially spaced by a constant pitch in confronting relation with said printing positions, inking means for alternately inking the characters of the circumferences of each one of said pairs with a first and second color, a plurality of hammer elements selectively operable for printing said characters in said printing positions and mounted on said frame and linearly arranged inside said hollow drum parallel to said printing line, drum supporting means comprising a first and a second cylindrical element respectively mounted at the ends of said drum and rotatable on said frame, said first element driving said drum at a rotational speed twice the rotational speed of said second element, said second element being connected with the drum for an axial displacement thereof and comprising a continuous cam element divided into a first and a second cam portion connected to each other and axially spaced therebetween by said pitch, each cam portion extending over 180° on the outside surface of said second cylindrical element, and color selecting means comprising a cam follow member selectively engageable with said first and said second cam portions to axially shift said drum during a second revolution thereof by one pitch in a first direction and respectively in an opposite direction with respect to a central position, whereby said hammer elements are so operable as to print characters of said first color successively in odd positions and in even positions of said printing line during two subsequent revolution of said drum when said cam follower member engages said first cam portion, while said hammer elements are so energized as to print characters of said second color successively in said even and in said odd positions during two subsequent revolutions of the drum when said cam follower engages said second cam portion.

2. A printer according to claim 1, wherein the characters of each pair of said adjacent circumferences are regularly and angularly shifted by half said angular spacing from the corresponding characters of an adjacent circumference whereby the characters which are inked with said first color are staggered by said half of said angular spacing with respect to the characters which are inked with said second color.

3. A printer according to claim 1, wherein said cam follow member comprises first and second pins which are angularly spaced from each other over 180°, said cam follow member being radially movable from a first position to a second position in which said first and second pins are alternately engaged with said first portion and respectively with said second portion for positively moving said drum during a second revolution thereof in said first direction and in said second direction respectively when said first pin is engaged with said cam, the characters of a first circumference of said pairs are printed with said first color and when said second pin is engaged with said cam the characters of a second circumference of said pairs are printed with said second color.

4. A printer according to claim 1, wherein said inking means comprises a plurality of inked discs mounted on a shaft which is parallel to the axis of said drum, said shaft being supported by elastic arms rigidly mounted at one end on a slider and being so dimensioned as to resiliently press said discs against the characters of said drum.

5. A printer according to claim 7, wherein said drum is rotated intermittently by a motor which is in a condition of permanent rotation, by way of a friction coupling comprising a cylindrical projection connected to said first cylindrical element and in frictional engagement with a hub of a driving gear rotated by said motor.

6. A printer according to claim 1, comprising an arithmetic logic unit and a microprocessor supplied by said arithmetic logic unit with a signal identifying one or other of said colors, wherein said printer comprises a device for selectively engaging said cam follow member with said first and second cam portions, said device being controlled by said microprocessor in response to said identifying signal.

7. A printer according to claim 5, wherein said engaging device comprises a solenoid connected to said cam follower and actuated by an actuating circuit controlled by said microprocessor.

8. A printer according to claim 4, wherein said first cylindrical element comprises a plurality of teeth arranged on the periphery thereof and angularly spaced by said half angular spacing, a single tooth adjacent said plurality of teeth, a stop member normally engaged with said single tooth to stop said drum after each revolution, said stop member being selectively activated to free said single tooth in response to a command signal from an actuator circuit and to lock said drum in positions corresponding to the characters of said circumstances.

* * * * *